US011618603B2

(12) United States Patent
Arregui Letamendi

(10) Patent No.: US 11,618,603 B2
(45) Date of Patent: Apr. 4, 2023

(54) TUBULAR GLASS BOTTLE NECK

(71) Applicant: DSIGNTANK, S.L., Barcelona (ES)

(72) Inventor: Jokin Arregui Letamendi, Barcelona (ES)

( * ) Notice: Subject to any disclaimer, the term of this patent is extended or adjusted under 35 U.S.C. 154(b) by 460 days.

(21) Appl. No.: 16/324,403

(22) PCT Filed: Aug. 9, 2017

(86) PCT No.: PCT/ES2017/000102
§ 371 (c)(1),
(2) Date: Feb. 8, 2019

(87) PCT Pub. No.: WO2018/029388
PCT Pub. Date: Feb. 15, 2018

(65) Prior Publication Data

US 2019/0168904 A1 Jun. 6, 2019

(30) Foreign Application Priority Data

Aug. 11, 2016 (ES) ..... ES201631024U

(51) Int. Cl.
*B65D 1/02* (2006.01)
*B65D 23/00* (2006.01)

(52) U.S. Cl.
CPC ..... *B65D 1/023* (2013.01); *B65D 1/0207* (2013.01); *B65D 23/00* (2013.01)

(58) Field of Classification Search
CPC ..... B65D 1/0207; B65D 81/3837; B65D 1/0253; B65D 1/023
USPC ..... 215/294
See application file for complete search history.

(56) References Cited

U.S. PATENT DOCUMENTS 2,069,075 A * 1/1937 Lunn ..... B65D 1/0253 215/326
2,551,937 A * 5/1951 Gallagher ..... B65D 43/022 215/45
3,942,660 A * 3/1976 Paller ..... B65D 1/023 215/45
4,412,623 A * 11/1983 Schmidt ..... A61J 9/00 215/11.1
4,591,060 A * 5/1986 Tsukada ..... B65D 1/023 215/42
5,544,770 A * 8/1996 Travisano ..... B65D 55/026 215/349
10,357,429 B2 * 7/2019 David ..... A61J 1/2055
(Continued)

*Primary Examiner* — Anthony D Stashick
*Assistant Examiner* — Raven Collins
(74) *Attorney, Agent, or Firm* — Eugenio J. Torres-Oyola; Victor M. Rodriguez-Reyes; Rafael Rodriguez-Muriel

(57) ABSTRACT

The present invention relates to a glass bottle neck suitable for the automatic production of bottles by means of a molding process for molding part of the neck of the bottle and subsequent blowing of the rest of the bottle, provided with an annular collar (20) for removing the bottle from the mold, wherein the neck consists of a collar segment (A) provided with an annular collar (20), a transition segment (B) provided with an annular outer recess (30), and a wide segment (C) with an outer wall face (11) flush with the outer collar face (21) and with an internal conduit (12) having a diameter that is larger than the internal conduit (12) of the collar segment (A), with the annular outer recess (30) being recessed with respect to the outer collar face (21) and with respect to the outer wall face (11) of the wide segment (C).

9 Claims, 4 Drawing Sheets

(56) References Cited

U.S. PATENT DOCUMENTS

| | | | | |
|---|---|---|---|---|
| 11,084,630 | B2 * | 8/2021 | Sergienko | B65D 39/0058 |
| 2003/0010668 | A1 * | 1/2003 | Taskis | B65D 51/30<br>215/294 |

* cited by examiner

TUBULAR GLASS BOTTLE NECK

TECHNICAL FIELD

The present invention relates to the field of tubular glass bottle necks, more specifically to necks of glass bottles that are manufactured automatically and provided with an annular collar in the form of a protruding annular glass flange around said neck molded simultaneously with the rest of the tubular bottle neck and used as a gripping point for removing the bottle from inside the mold after the manufacture thereof.

The proposed glass bottle neck is suitable for the automatic production of bottles by means of a molding process for molding part of the neck of the bottle and subsequent blowing of the rest of the bottle, provided with an annular collar for removing the bottle from the mold, wherein the neck consists of a collar segment provided with an annular collar, a transition segment provided with an annular outer recess, and a wide segment with an outer wall face flush with the outer collar face and with an internal conduit having a diameter that is larger than the internal conduit of the collar segment, with the annular outer recess being recessed with respect to the outer collar face and with respect to the outer wall face of the wide segment.

STATE OF THE ART

Tubular glass bottle necks are known in the state of the art. In those bottles produced automatically by means of glassblowing inside a mold, it is also common to include an annular collar around the tubular neck, in a position close to the mouth of the neck, with the mentioned collar and mouth of the neck being produced in a prior molding stop, which allows a very precise dimensional control of the diameter of the mouth of the tubular neck and the use of said collar for gripping the bottle and removing it from the mold automatically after the manufacture thereof. Machines for automatically manufacturing glass bottles with industrial production volumes used today are all based on this manufacturing principle, described for the first time in patent U.S. Pat. No. 774,690 from 1904.

However said collar, required for the industrial manufacture of bottles, produces a projection on the outside of the tubular neck, which, in the case of beverage bottles, makes it difficult to place a capsule and remove it, and it does not help with the shearing off of said capsule, and it could furthermore be an impediment for handling the bottle, or for placing labels on said neck.

In bottles of another type, such as bottles provided with a thread, for example, produced automatically with a process identical to the one described before, said collar typically must necessarily be arranged farther away from the mouth than the thread, with the thread being above the collar so as to prevent the collar from interfering with the screw cap, preventing its access to the thread of the neck. Therefore, the conventional construction of necks with a thread consists of, in this order starting from the mouth, the thread, the collar, and finally the shoulders of the bottle. This construction determines that there is always a groove between the cap and shoulders of the bottle which is defined by the distance existing between the collar and said shoulders, preventing the cap from being able to rest on the shoulders unless special caps that are very expensive to produce are used; it is even more common for the collar to be completely visible, included in said groove, which affects the aesthetic appearance of the product.

Bottles manufactured with different techniques other than molding the mouth with a collar and subsequent blowing of the rest of the body of the bottle are known, where these techniques allow dispensing with the collar, but production costs are much higher as they are not industrial-scale techniques, such as artisanal techniques, semi-artisanal techniques, or other techniques based on other principles, such as the narrowing of a tube of glass, for example, shaping it into a bottle.

Bottles with a neck devoid of a collar are known, which make labeling tasks easier, and furthermore include an annular groove around same suitable for serving as a guide for shearing off a cap placed on the neck, or for serving as a drip edge, although that is not the objective proposed in the documents describing those solutions.

Documents GB189714441A and GB189725405A are examples of documents of that type, both documents being earlier than the invention for the automatic manufacture by molded the mouth and subsequent blowing, so they do not correspond to bottles produced with said technique.

Furthermore, in both cases the thickness of the glass of the neck of the bottle is constant, except in the mentioned groove, where its thickness is reduced, constituting a weakening whereby facilitating the breaking of the neck at that point for opening same, with the inner diameter of the bottle being constant. This indicates that the type of glass used is a borosilicate glass the breaking of which does not produce sharp edges or shards, with that material being typical during production staring from a preformed glass tube which is then heated and narrowed at its ends, forming a bottle or container, which is confirmed by the absence of a collar, which is impossible to obtain using other industrial-scale techniques.

This technique does not allow automatic large-scale production at competitive prices compared to the manufacture by molding and subsequent blowing, since it requires first producing a glass tube, and then molding it, resulting in a bottle made of a brittle glass.

Therefore, in conclusion, there is no known solution which allows the automatic manufacture of bottles by means of the techniques and machines normally found in the sector, which use the technique of molding the mouth with a collar and then blowing the body of the bottle, but without the drawbacks of having an annular projection in the form of a collar around the bottle neck, which makes it difficult to label and screw caps on around same.

BRIEF DESCRIPTION OF THE INVENTION

The present invention relates to a tubular glass bottle neck, particularly a tubular neck of glass bottles that are produced automatically.

The term bottle must be understood not to entail a limitation to a single type of containers, but rather the present invention is extensible to any other glass container provided with a neck and a mouth obtained by molding part of the neck and the mouth by molding and subsequent blowing of the rest of said container, such as for example jars, jugs and vases.

For their automatic manufacture, glass bottles require an a annular projection adjacent to the mouth of the neck of the bottle which allows a firm gripping of the bottle during the manufacture thereof for transferring the molten glass preform from the forming mold for forming the mouth to the blow mold and for removing the bottle from inside the blow mold after the manufacture thereof by blowing. Said annular projection is typically achieved by including a protruding annular collar in the form of an annular flange projecting from the outer face of the bottle neck providing an annular collar projection which performs the described function. Said collar is present in bottles devoid of a thread on its neck, such as bottles of wines, sparkling wines, and other beverages, for example preferably in bottles stoppered with a cork or plastic stopper inserted under pressure; are also known bottles provided with a thread which also include the mentioned collar, especially in jars for food or cosmetic use.

The insertion of the stopper under pressure into the tubular neck requires enormous precision in the manufacture thereof, especially in the part of the inner conduit closer to the mouth, where the stopper must be fixed; as a result, the tolerances allowed in the manufacture of that part are much stricter than those of the rest of the tubular neck. The same occurs with the outer dimensions of the threads in screw caps.

The usual manner of obtaining said neck and achieving the desired precision consists of molding a preform which includes that most critical area adjacent to the mouth, including the collar and the inner conduit closer to the mouth, pressing the molten glass inside the mold with a pressurized gas or with a piston, thereby compacting the glass and the glass being perfectly fitted with the mold. Then, and before the glass hardens, the obtained preform is removed and introduced in another blow mold, where the rest of the neck and the body of the bottle are formed by means of blowing of pressurized air through the mouth formed in the preform, which expands the preform until adapting it to the shape of the mold, but without the parts closer to the mouth being altered, therefore the strict tolerances of that part are complied with, whereas in the rest of the bottle the thickness will be kept within the higher tolerances. The formed bottle is then removed from the blow mold.

In the operations for removing both the preform and the bottle from inside the molds, the collar is essential as it allows proper gripping of the glass by the automatic production apparatus.

The tubular glass bottle neck therefore includes:

- a tubular wall defining an inner conduit, an outer wall face, and a mouth accessible from outside the bottle and connected in continuation to a bottle body;
- a protruding annular collar on the outer surface of the tubular wall in a position adjacent to the mouth, with said annular collar being provided with an outer collar face confined between two annular collar projections;

It will therefore be understood that the proposed neck will be connected in continuation to a bottle body, for example through shoulders interposed between the bottle body and the tubular neck, with the inside of said bottle body only being accessible through the tubular bottle neck and mouth.

The proposed bottle neck furthermore includes the following features:

- said tubular wall defines a collar segment, a transition segment, and a wide segment successive to and aligned with one another and with their respective inner conduits being connected to one another,
- the collar segment includes the annular collar and the mouth, with the thickness of the annular collar being added to the thickness of the tubular wall in at least part of said collar segment;
- the outer wall face of the wide segment is flush with the outer collar face, and the inner conduit thereof has a cross section having a larger size than the cross section of the inner conduit of the collar segment; and
- the transition segment links the collar segment and the wide segment, the inner conduit thereof comprises successive cross sections having an increasing size connecting the inner conduits of the collar segment and the wide segment, and outer wall face thereof has at least two successive cross sections having a different size, connecting the outer wall faces of the collar segment and the wide segment, defining an annular outer recess between the collar and the wide segment.

Therefore, the outer collar face and the outer wall face are flush with one another in their wide segment, avoiding outer projections and protrusions in the bottle neck, and they are separated from one another by an annular outer recess in which there is provided an annular collar projection which allows gripping the bottle for removing it from the mold during the manufacture thereof, and producing a unique aesthetic effect, since the collar is visually integrated in the tubular neck assembly, without projecting from same, as a result of the increase in diameter of the wide segment until it is externally flush with the collar.

Preferably, the thickness of the tubular wall will be the same in the collar segment and in the wide segment, and it can also be the same in at least the annular outer recess and/or in the entire transition segment.

Having the collar and outer face flush with another allows facilitating, for example in beverage bottles, the operations of inserting and removing a capsule, for example a metal or plastic, and will even allow the use of materials which could not be used up until now as they did not provide sufficient flexibility or malleability or retraction capacity to be fitted around the collar normally used, allowing the use of more cost-efficient materials. The fact that the outer collar face and the outer wall face are flush with one another in their wide segment also allows the inclusion of labels on that area without the drawback of the projection of a conventional collar.

For storing and transporting bottles, it is common to arrange the bottles upright and grouped together, leaving gaps between them, to place thereon a board provided with perforations provided for being inserted around the necks of the bottles, such that said necks project above said board, and to provide an additional level of bottles supported on said board such that the bottle necks protruding from the board are arranged in the gaps existing between said bottles of the upper level. This system can be repeated by stacking multiple levels of bottles, maximizing storage. In this context, having a neck without protruding projections such as the one proposed facilitates and simplifies the operations for placing, and especially for removing, said boards provided with perforations on or from said bottle necks, respectively, as the projections produced by the collares engage the board and make removing it cumbersome.

Another additional advantage of the proposed solution is to facilitate the shearing off of the capsule for its partial removal, as the annular outer recess serves as an unequivocal guide for cutting the capsule as it is the only projection existing in the neck, preventing confusion in consumers, and the inexistence of protrusions facilitates the extraction of the upper portion of said capsule. This solution furthermore allows the edge created on the capsule after it is cut, which may be sharp, to be bent into the annular outer recess created around the neck of the bottle, preventing the risk of a user being cut.

The annular outer recess furthermore allows acting like a drip cap, preventing a drop from running along the neck of the bottle, adhered thereby by surface tension, and staining the hand of the person holding the bottle or the table or tablecloth on which said bottle is placed. Said annular outer recess will retain said drop and interrupt its forward movement, something that usual collar solutions do not allow.

Furthermore, since the width of the inner conduit is greater in the wide segment than in the collar segment, producing a narrowing in the transition segment, a slight ramp is produced inside the bottle neck which may allow retaining any dreg which may have reached the bottle neck from the bottle body, where said ramp allows an additional retention of dregs. This function is especially relevant in the case of containing wines, which tend to contain dregs. Furthermore, this feature allows achieving the neck and the collar being externally flush with one another without the entire neck having the thickness of the sum of the collar and of the tubular wall, and therefore achieving a savings in glass and weight, and lower cost of the bottle.

The collar segment and at least part of the transition segment are formed by the molding process described above, whereas the rest of the transition segment and the entire wide segment are formed by the blowing process described above. This is due to the fact that with the initial molding process, only a straight inner conduit with a constant section or a segment with a decreasing section can be formed, rendering it impossible to make an inner conduit with an increasing section moving away from the mouth, as it would be impossible to remove the mold of the inner conduit through the mouth. Therefore all the parts of the bottle neck in which the dimension of the inner conduit is larger than the dimension of the inner conduit of the collar segment are necessarily produced during the blowing step.

It is additionally proposed that the length of the tubular wall covered by the annular collar is greater than the length of the tubular wall on which the annular outer recess is defined, with the width of the annular outer recess preferably being equal to or less than 5 mm. However in some cases, such as in bottles with a crown cork pressed around the mouth, for example, it is contemplated that said annular outer recess may be larger to allow housing the crown of the stopper, leaving space so that an opener can access the mentioned crown.

According to an additional embodiment, the mentioned annual outer recess is confined between one of the annular collar projections and an annular wall projection, facing said annular collar projection, with the annular wall projection being defined by an abrupt change in size between two successive cross sections of the outer face of the transition segment. Therefore, the outer wall face of said transition segment can abruptly change in section, determining an annular wall projection facing the collar projection and similar or identical to same, determining a much more defined annular outer recess.

Preferably the width of the annular outer recess will be equal to or less than its depth.

In said collar segment, the thickness of the annular collar will be added to the thickness of the tubular wall, for example in at least the largest part of said collar segment, but preferably in the entire collar segment, with an annular collar projection being flush with the mouth. This solution prevents the formation of a step next to the mouth of the bottle neck and offers better support for the corkscrew.

The thickness of the tubular wall of the wide segment is proposed to be comprised between 80% and 120% of the thickness of the tubular wall of the annular outer recess of the transition segment. It is thereby assured that said recess will not constitute a perceivable weakening of the strength of the bottle neck, preventing the risk of the bottle neck breaking at said annular outer recess.

It is additionally contemplated that the inner conduit of the collar segment may contain a cork or plastic stopper tightly fitted therein. It is assured that the stopper is held inside the inner conduit along its entire length by means of the precise control of the tolerances mentioned above.

It is furthermore proposed that a capsule externally and tightly covers at least the mouth, the collar segment, and the transition segment, and also at least part of the wide segment as well.

Said capsule can have a portion at least partially inserted in said annular outer recess, providing it with grip and on said bottle neck.

The capsule can alternatively or additionally be attached to the neck of the bottle by other means, for example by means of adhesives, or by means of a slight tapering of the outer collar face and/or of the outer wall face, with the widest end being the closer to the mouth.

It is also proposed that at least one of the following elements has a cylindrical geometry:

- the inner conduit of the collar segment and/or of the wide segment, and/or
- the outer wall face of the collar segment and/or of the wide segment, and/or
- the outer collar face.

It is proposed that at least part of the outer collar face and/or at least part of the outer wall face of the wide segment is printed, silk-screened, engraved, or labeled with an adhesive label, or preferably that both faces are at least partially covered by a common printed, silk-screened, or engraved motif or labeled with an adhesive label. This feature is possible as a result of both faces being flush with one another and therefore have a visual continuity only briefly interrupted by the annular outer recess, which allows a motif distributed between the outer collar face and the outer wall face of the wide segment to be perceived by a user as a continuous motif. This opens up many design possibilities that used to be inexistent as a result of the proposed invention.

According to another additional proposed embodiment, the transition segment includes a recess portion adjacent to the collar segment, where the annular outer recess is defined, and a wide portion adjacent to the wide segment from the outer wall face of which they project protrusions defining at least one screw thread for screwing on a complementary cap. This embodiment allows the creation of a bottle neck provided with a thread located farther away from the mouth than the collar, such that when the cap is attached to the thread the collar is concealed by the cap.

Said thread could be produced by means of a molding process prior to the blowing process, thereby assuring a precise manufacture.

It is furthermore considered that the wide segment, arranged after the wide portion of the transition segment provided with the screw thread, connects with bottle shoulders, said wide segment having a length equal to or less than 5 mm. The scarce length of said wide segment, of a few millimeters, allows bringing the screw thread as close as possible to the shoulders of the bottle, allowing the cap to be virtually in contact or in contact with the shoulders of the bottle when said cap is coupled to the thread, eliminating a groove where dirt may build up or which can make it difficult to put labels on the bottle, in addition to providing the assembly with a distinctive, especially when the annular outer face of the cap screwed onto the screw thread is coplanar with the annular outer face of the body of the bottle located below the shoulders.

According to another embodiment that is provided, a ring made of an elastic material is inserted in the annular outer recess for fixing accessories to the neck of the bottle. This allows fixing, for example, a stopper for the mouth of the bottle by means of a flexible arm, with said stopper being attached to the neck of the bottle through said ring made of elastic material when it is not stoppering the mouth of the bottle. Other accessories may be fixed to the neck of the bottle, such as, for example, promotional products, free samples, labels, etc.

It will be understood that references to geometric position, such as, for example, parallel, perpendicular, tangent, etc., allow for deviations of up to ±5° with respect to the theoretical position defined by said nomenclature.

It will also be understood that any range of values that is offered may not be optimal at its extreme values and may require adaptations of the invention so that said extreme values are applicable, with said adaptations being within reach of one skilled in the art.

Other features of the invention can be found in the following detailed description of an embodiment.

BRIEF DESCRIPTION OF THE DRAWINGS

The preceding and other advantages and features will be better understood from the following detailed description of an embodiment in reference to the attached drawings, which must be interpreted by way of non-limiting illustration, in which.

DETAILED DESCRIPTION OF AN EMBODIMENT

Figure 1:
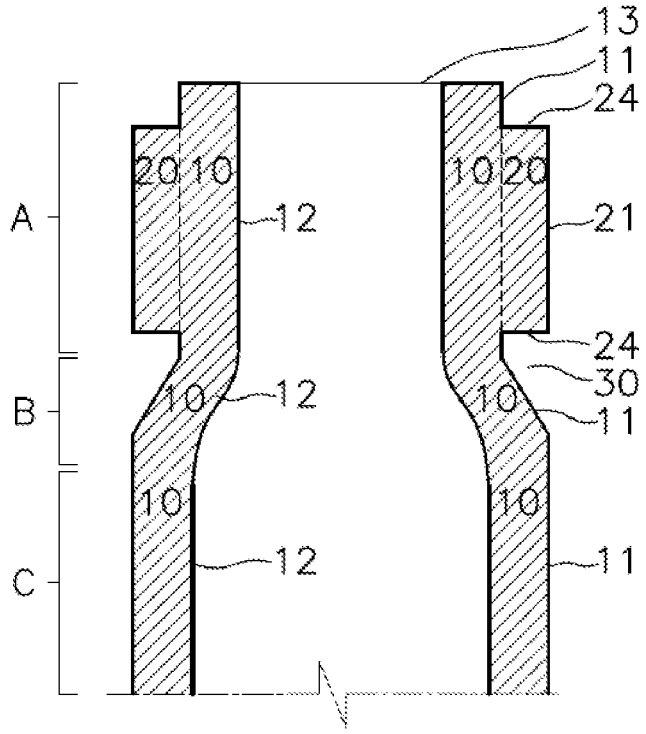
FIG. 1 shows a longitudinal section of a tubular glass bottle neck according to a first embodiment.

FIG. 1 shows a view of a first embodiment of the tubular glass bottle neck with an illustrative and non-limiting character. In this embodiment, it is proposed that the bottle neck has a circular section, although it may naturally be oval, square, rectangular, or of any other forma without this affecting its features.

The proposed neck consists of a tubular wall 10, defining a tubular conduit 12, an outer wall face 11, and a mouth 13, where the tubular conduit 12 communicates the inside of the body of the bottle, connected to the tubular neck, with the outside thereof.

On said outer wall face 11 of the tubular wall 10 there is located an annular collar 20, in the form of a protruding flange attached on the tubular wall 10, with the thickness of the glass of the tubular wall 10 being added to the thickness of the glass of the collar 20, generating a portion of the bottle neck with a thickness greater than that of the rest of the tubular wall 10. The mentioned collar 20 consists of an outer collar face 21, with this being the most exposed face of the collar 20, demarcated by two annular collar projections 24, which separate and space the outer collar face 21 from the outer wall face 11.

Figure 4:
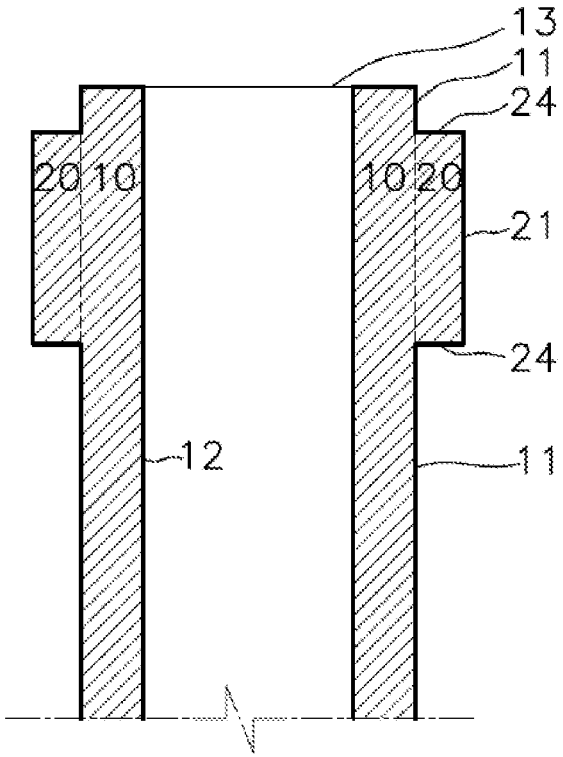
FIG. 4 shows a longitudinal section of a tubular glass bottle neck according to the known state of the art.

The mentioned collar 20 and the tubular wall 10 will be made of one and the same material and will be integral with one another, formed of a single part. Up to this point the description corresponds to the existing state of the art shown in FIG. 4.

Figure 2:
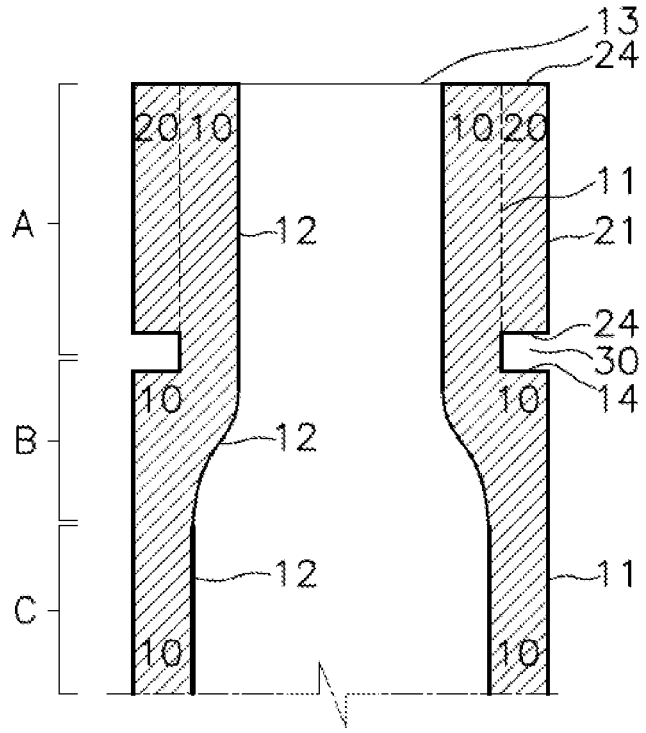
FIG. 2 shows a longitudinal section of a tubular glass bottle neck according to a second embodiment.
Figure 3:
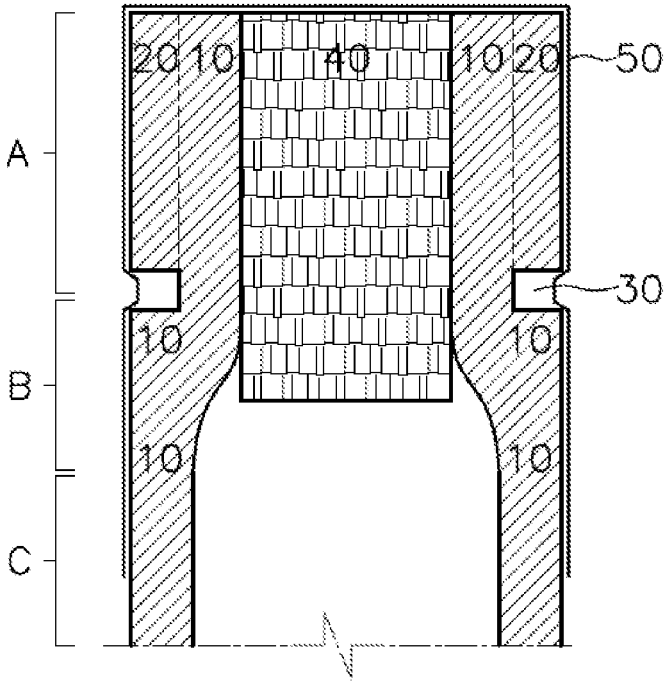
FIG. 3 shows the same view shown in FIG. 2, including a stopper and a capsule on the tubular neck.

According to the embodiments shown in FIGS. 1, 2, and 3, the segment of the bottle neck where the collar 20 and the mouth 13 are located is referred to as collar segment A. According to the proposed invention, two other segments are defined in continuity with said collar segment A, which segments are, in this order, transition segment B and wide segment C.

The mentioned wide segment C has its corresponding outer wall face 11 flush with the outer collar face 21, and the inner conduit 12 of the wide segment C has a cross section with a size greater than the cross section size of the collar segment A. The widening of said inner conduit from the collar segment A to the wide segment C occurs in the so-called transition segment B, which is placed between and connects both segments, with the successive cross sections of the inner conduit 12 of the transition segment B having an increasing size to produce said widening.

The outer wall face 11 of the transition segment B also transitions from the cross section size of the outer wall face 11 of the collar segment A, to the cross section size of the outer wall face 11 of the wide segment B, with at least two successive cross sections of the outer wall face 11 of the transition segment B having a different size. Said change in the size of the outer wall face 11 generates an annular outer recess 30 between the collar 20 and the wide segment C.

According to the first embodiment shown in FIG. 1, the transition of the outer wall face 11 of the transition segment B is a gentle transition, with the annular outer recess 30 therefore being generated such that it is confined between an annular collar projection 24 and a gentle slope of the outer wall face 11 of the transition segment B.

However, and according to the embodiment shown in FIGS. 2 and 3, said transition in the cross section size of the outer wall face 11 can be abrupt. In that case, an annular wall projection 14 is generated perpendicular to the outer wall face 11 facing the annular collar projection 24 confining the annular outer recess 30.

In this embodiment, furthermore, the annular collar projection 24 closer to the mouth 13 is located flush with said mouth 13. An additional step of the proposed bottle neck which may make it difficult for a capsule 50 to be secured on said bottle neck is thereby eliminated. Furthermore, the elimination of said step, combined with the outer collar face 21 being flush with the outer wall face 11, causes the collar 20 to visually disappear. In this case, and for the sake of comprehension, it will be considered that the thickness of the tubular wall 10 in the collar segment A is equal to the thickness of the tubular wall 10 in the wide segment C, with the remaining thickness being the thickness of the collar 20, or that it is equal to the smallest thickness of the tubular wall 10 in the annular outer recess 30. In all the attached figures, the imaginary separation existing between the collar 20 and the outer wall face 11 on which it is placed is indicated with a discontinuous line.

In all the embodiments that are shown, the minimum thickness of the tubular wall 10 in the annular outer recess 30 is equal to the thickness of the tubular wall 10 in the wide segment C, thereby preventing said annular outer recess 30 from being a weakening of the bottle neck. However, it is considered that there may be certain thinning of up to 20% of said thickness without generating a substantial weakening of the bottle neck in said annular outer recess 30.

FIG. 3 shows the same embodiment as FIG. 2, but with a cork stopper 40 inserted inside the inner conduit 12 of the collar segment A, and with a capsule 50 covering the mouth 13, the collar segment A, the transition segment B, and part of the wide segment C. In this embodiment, the capsule 50 is narrowed coinciding with the annular outer recess 30, with said narrowing being partially inserted inside the annular outer recess 30, retaining the capsule 50 in its position.

The mentioned annular outer recess 30 can therefore be used as a guide for the shearing off of the capsule for its partial removal, freeing access to the stopper 40 inserted inside the tubular conduit 12.

Figure 5:
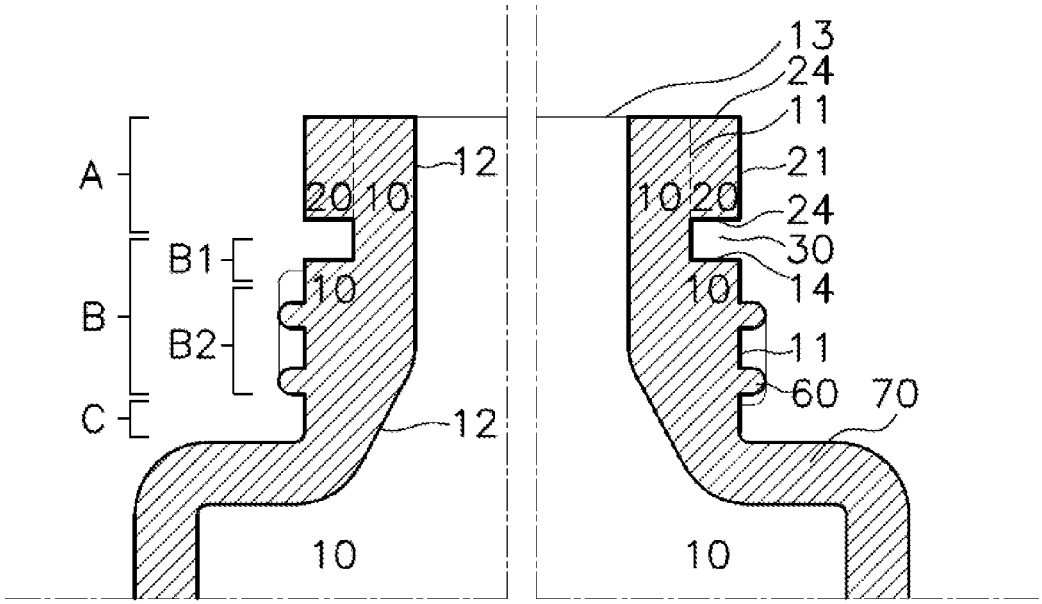
FIG. 5 shows a longitudinal section of a tubular glass bottle neck according to another proposed embodiment provided with a screw thread around the transition segment, in a bottle provided with shoulders in which the wide segment is a few millimeters in length.

FIG. 5 shows an embodiment of a of bottle neck provided with protrusions acting like a screw thread 60.

According to this embodiment, the transition segment B is divided into a collar portion B1 adjacent to the annular collar 20 and containing the annular outer recess 30, and a wide portion B2 adjacent to the wide segment C and containing the mentioned screw thread 60 protruding from its outer wall face 11.

This embodiment allows placing the annular collar 20 above the screw thread 60, closer to the mouth 13, and when the cap is placed the annular collar 20 is concealed inside the cap without said annular collar 20 being an impediment for access of the cap or its screw thread, since the annular collar 20 is flush with the outer wall face 11 from which the screw thread 60 of the bottle neck projects.

In the embodiment shown, the wide segment C is furthermore connected to bottle shoulders 70 which widen the body of the bottle with respect to the neck of the bottle. In this embodiment, the length of the wide segment is very short, less than 5 mm, such that the screw thread 60 is adjacent to said shoulders 70. This allows the cap to be adjacent or in contact with said shoulders when said cap is attached to the screw thread 60, thereby reducing or eliminating the groove typically existing between the cap and the shoulders of the bottle.

This embodiment is especially useful for the producing jars, for example for food or cosmetic use.

Figure 6:
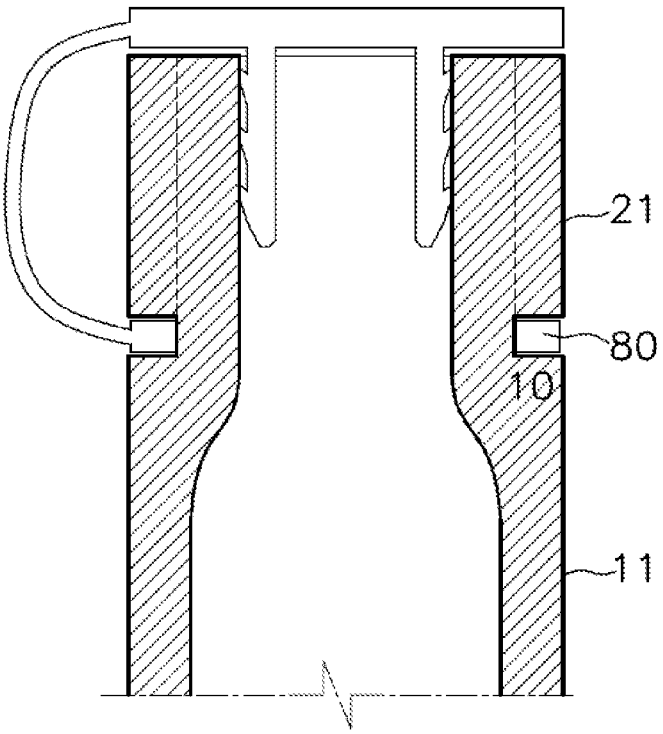
FIG. 6 shows the same bottle neck as in FIG. 2, but including a ring made of an elastic material inserted in the annular outer recess, with said ring being connected by means of an elastic arm to a stopper that can be inserted in the mouth of the bottle neck.

FIG. 6 shows another embodiment of the bottle neck identical to the one shown in FIG. 2, in which a ring 80 made of an elastic material has been inserted inside the annular outer recess 30 defined in the transition segment B. Said ring 80 serves as an anchor for attaching accessories to the neck of the bottle. In this example, the ring 80 has been used for attaching it to a stopper of the mouth 13 of the bottle by means of a flexible arm, thereby achieving that the stopper remains attached to the neck of the bottle after being removed from the mouth 13, preventing it from being lost.

As will be understood, other accessories can be attached to the ring 80, such as, for example, promotional products, advertisements, gifts, labels, metering devices, cups or glasses, etc.

Figure 7:
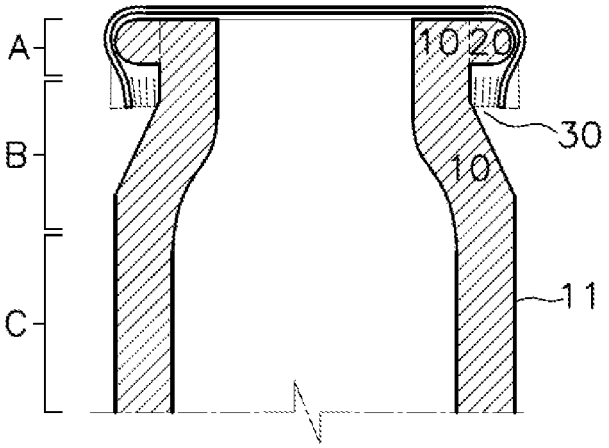
FIG. 7 shows a longitudinal section of the bottle neck according to another embodiment in which the mouth is closed by means of a crown cork, with the annular outer recess being close to the mouth and sized to house the crown of the cap acting as a crown cork.

FIG. 7 shows another embodiment suitable for the placement of crown corks, for example, for beer bottles covered with a cap provided with a crown. In this embodiment, it is proposed that the collar produces the annular projection around which the crown of the cap is closed, with the collar being completely surrounded by said cap, and with the crown of the cap being partially inserted inside the annular outer recess defined in the transition segment. This embodiment furthermore proposes that the transition segment defines in the outer wall face a ramp-like portion below the annular outer recess, which allows the insertion of an opener inside the annular outer recess to enable acting as a lever on the crown of the cap for the release thereof.

It will be understood that the different parts forming the invention described in one embodiment can be freely combined with the parts described in other different embodiments even though said combination has not been explicitly described provided that the combination does not entail any drawback.

The invention claimed is:

1. A single-piece glass bottle comprising a tubular wall defining a bottle body and a bottle neck connected through interposed shoulders;

the bottle neck has a bottle mouth on one first end and is connected to the shoulders through one second end opposed to the first end, the bottle neck defining a collar segment, a transition segment, and a wide segment in succession, the collar segment including the bottle mouth and a protruding annular collar around the collar segment defining a thickening of the tubular glass wall;

the transition segment has a wall outer face of the tubular wall recessed in regard to a wall outer face of the tubular wall on the annular collar;

the wide segment has an outer face flush with an outer face of the annular collar, the wide segment defining a first exterior widening of the glass bottle, visually integrating the collar in the tubular neck, and is connected to the bottle body through the shoulders which define a second exterior widening of the glass bottle;

the tubular wall has a wall inner face, defining an inner conduit, comprising a first portion, producible in a press mold inserted through the bottle mouth, and a second portion, producible in a blow mold, the first portion comprising the collar segment and at least part of the transition segment and having a constant cross sectional area or a decreasing cross sectional area away from the bottle mouth, and the second portion comprising a portion of the transition segment with an increasing cross sectional area towards the wide segment, defining a first inner widening of the glass bottle, the wide segment with a cross sectional area bigger than the cross sectional area of the inner conduit on the collar segment reducing the glass required for its fabrication, the shoulders, which define a second inner widening of the glass bottle, and the bottle body.

2. The single-piece glass bottle according to claim 1, wherein the recessed wall outer face of the tubular wall of the transition segment, which is recessed in regard to a wall outer face of the tubular wall on the annular collar, is an annular outer recess, and the length of the tubular wall covered by the annular collar is greater than the length of the tubular wall on which the annular outer recess is defined.

3. The single-piece glass bottle according to claim 1, wherein the recessed wall outer face of the tubular wall of the transition segment, which is recessed in regard to a wall outer face of the tubular wall on the annular collar, is an annular outer recess, and the annular outer recess has a width equal to or less than 5 mm and/or wherein the width of the annular outer recess is equal to or less than its depth.

4. The single-piece glass bottle according to claim 1 wherein the recessed wall outer face of the tubular wall of the transition segment, which is recessed in regard to a wall outer face of the tubular wall on the annular collar, is an annular outer recess, and the wall outer face of the annular collar is confined between two annular collar projection faces, and wherein the mentioned annular outer recess is confined between one of the annular collar projections faces and an annular wall projection face, facing said annular collar projection face, with the annular wall projection face being defined by an abrupt change in size between two successive cross sections of the wall outer face of the tubular wall on the transition segment.

5. The single-piece glass bottle according to claim 1, wherein in said collar segment the thickening of the tubular wall is defined in at least the largest part of said collar segment.

6. The single-piece glass bottle according to claim 1, wherein the wall outer face of the annular collar is confined between two annular collar projection faces, and wherein in said collar segment the thickening of the tubular wall is defined in the entire collar segment, with an annular collar projection face being flush with the mouth.

7. The single-piece glass bottle according to claim 1, wherein the recessed wall outer face of the tubular wall of the transition segment, which is recessed in regard to a wall outer face of the tubular wall on the annular collar, is an annular outer recess, and the thickness of the tubular wall of the wide segment is comprised between 80% and 120% of the thickness of the tubular wall of the annular outer recess of the transition segment.

8. The single-piece glass bottle according to claim 1, wherein at least one of the following elements has a cylindrical geometry:

- the inner conduit of the collar segment and/or of the wide segment, and/or
- the wall outer face of the collar segment and/or of the wide segment, and/or
- the wall outer face of the annular collar.

9. The single-piece glass bottle according to claim 1, wherein at least part of the wall outer face of the annular collar and/or at least part of the wall outer face of the wide segment are printed, silk-screened, or engraved, or labeled with an adhesive label, or wherein both faces are printed, silk-screened, or engraved, or labeled with an adhesive label, with a continuous motif at least partially covering both faces.

* * * * *